US005533600A

United States Patent [19]

Van Himbeeck et al.

[11] Patent Number: 5,533,600

[45] Date of Patent: Jul. 9, 1996

[54] RECESSED MULTIPURPOSE GARMENT BAG HOOK

[75] Inventors: Clemens Van Himbeeck, Maarkedal; Johan Vanderwee, Middelkerke, both of Belgium

[73] Assignee: Samsonite Corporation, Denver, Colo.

[21] Appl. No.: 227,550

[22] Filed: Apr. 14, 1994

[51] Int. Cl.[6] ..... A45C 13/22; A45C 13/28

[52] U.S. Cl. ..... 190/18 R; 190/39; 190/115; 206/278; 206/287.1; 383/23

[58] Field of Search ..... 206/278, 279, 206/287, 287.1, 289; 383/23; 190/18 A, 115, 39; 16/115

[56] References Cited

U.S. PATENT DOCUMENTS

| | | | |
|---|---|---|---|
| 746,617 | 12/1903 | Wenzell | 190/102 |
| 2,478,192 | 8/1949 | Harker | 16/115 X |
| 3,221,848 | 12/1965 | O'Neil | 206/289 |
| 3,289,985 | 12/1966 | Sheiman | 383/23 X |
| 3,958,675 | 5/1976 | Rosenblum | 206/287.1 |
| 4,342,479 | 8/1982 | Hofer | 206/279 X |
| 4,508,202 | 4/1985 | Siegert et al. | 190/115 |
| 4,542,824 | 9/1985 | Allen | 206/287.1 |
| 4,685,560 | 8/1987 | King | 206/287.1 |
| 4,858,867 | 8/1989 | King | 248/214 |
| 5,064,061 | 11/1991 | Moxley | 206/289 |
| 5,352,006 | 10/1994 | Ocuin | 206/289 X |

FOREIGN PATENT DOCUMENTS

| | | | |
|---|---|---|---|
| 4221215 | 1/1994 | Germany | 190/102 |

OTHER PUBLICATIONS

Delsey Corporation Garment Bag Hook ("Snappy") (No date available).

*Primary Examiner*—Sue A. Weaver
*Attorney, Agent, or Firm*—Gregory W. O'Connor; Rod D. Baker

[57] ABSTRACT

A recessed hook assembly positions a hook member at an exterior surface of a garment bag in such a manner that external unanticipated random forces are generally ineffective in dislodging the hook from the recess, but still allows it to be relatively easily dislodged and extended by the user to lift the garment bag and suspend it. The recessed hook assembly includes a housing defining a recess, an elongated flexible member connected to the hook member, and a retraction mechanism connected to the other end of the flexible elongated member to hold the hook member in the recess and still allow it to be easily removed for suspending the garment bag. The interaction of these elements also creates a handle for carrying, maneuvering or lifting the closed garment bag.

15 Claims, 4 Drawing Sheets

20
24
26
28
30
32
34
36
40
42
44
46
48
52
54
56
58
60
62
64
68
72
80
81
82
83
84
86
87
88
89
90
96
100
102
104
106
108
110
112
113
22

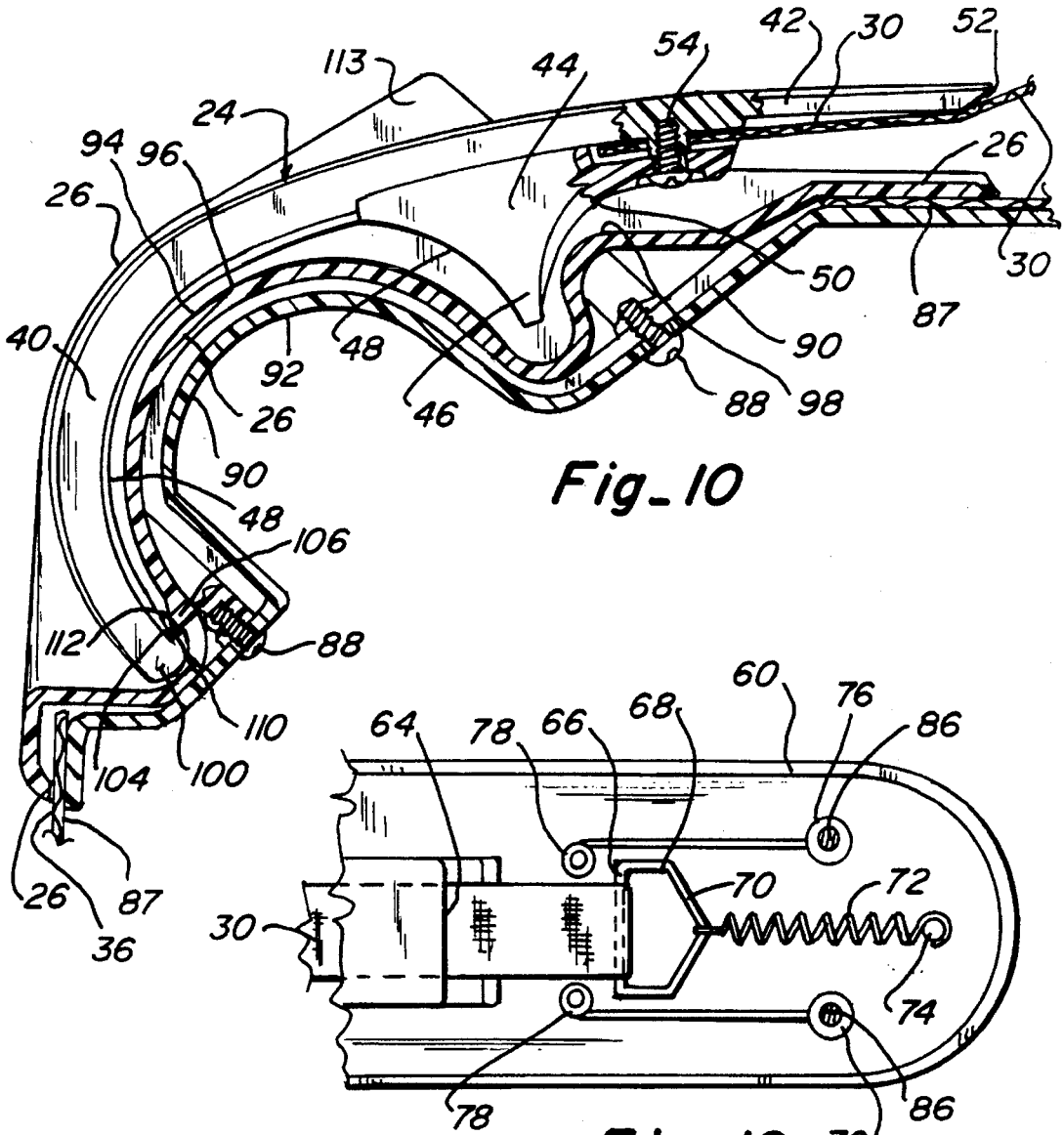
Fig_10
Fig_12
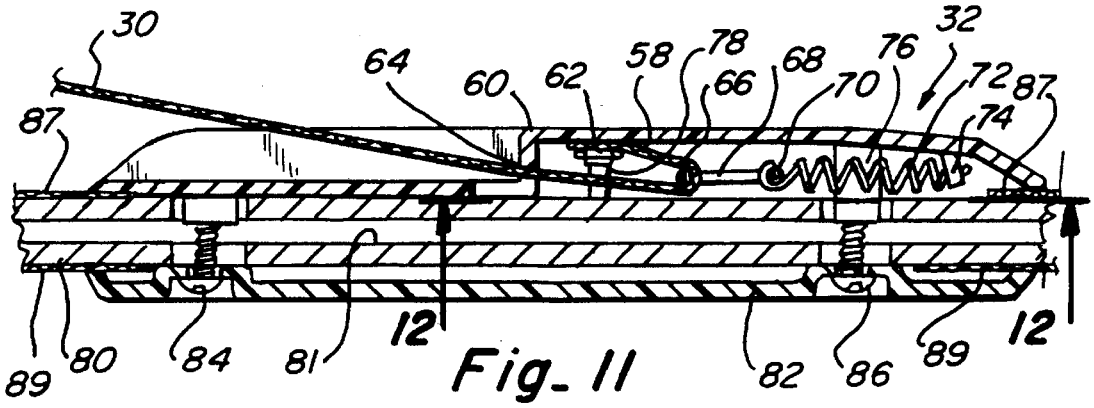
Fig_11

RECESSED MULTIPURPOSE GARMENT BAG HOOK

This invention generally relates to luggage, specifically garment bags of the type having a hook to suspend the open garment bag from a closet rod or an upper edge of an open door. More particularly, the present invention relates to a new and improved technique for recessing the hook in a housing receptacle on the exterior of the garment bag, thereby greatly inhibiting the possibility of dislodging the hook when transporting the garment bag and achieving additional functionality from the hook, such as an additional carrying or support handle for the folded garment bag.

BACKGROUND OF THE INVENTION

By far the most popular type of garment bag used in traveling is the type which includes a hook to hang or suspend the open garment bag from a closet rod or from an upper edge of an open door. With the garment bag suspended vertically from the hook, the user obtains convenient access to the personal clothing items which are suspended or hung on hangers within the garment bag. The popularity of these types of garment bags can be attributed to a considerable degree to the ease of packing and unpacking the garment bag, to the general convenience of using the garment bag without unpacking it, and to the relative ease of transporting the garment bag by folding it into a convenient size for carrying by hand or by a shoulder strap.

In order to obtain the conveniences of suspending the garment bag vertically, a hook must be provided at an upper edge of the garment bag. The hook is generally accessible from the exterior of the garment bag because it is necessary to lift the garment bag by the hook to place the hook over the closet rod or the door edge. Generally, the garment bag will be unfolded from its closed position on a bed or other horizontal surface. Thereafter the hook is grasped and the garment bag is lifted by the hook to the closet rod or the door edge. By making the hook available on the exterior of the bag, the user can suspend the bag before it is opened and its interior contents are exposed. Similarly, the bag may be fully packed and closed before the garment bag is lifted off of the closet rod or door edge by gripping the hook and carried to a horizontal surface where it is laid flat prior to folding it over into the closed position.

One of the difficulties associated with placing the hook on the exterior of the garment bag is that it is exposed when the bag is in the closed position during transportation. The hook cannot hang loosely from the bag in the closed position because it is likely to catch on objects and create an inconvenience during transportation. Consequently, a number of different techniques have evolved for attempting to keep the hook in place when the garment bag is closed during transportation.

One technique to keep the hook in place when the garment bag is closed involves placing the hook through a loop. It is anticipated that the loop will hold the hook during transportation of the garment bag. Sometimes the loop is placed on an adjoining opposite edge of the folded garment bag (the lower edge when the garment bag is vertically suspended) to allow the hook to span between the opposite edges and help hold the garment bag in the closed position. Unfortunately the exposure of the hook while in the loop, and the relative flexibility of the garment bag, allows the hook to become relatively easily dislodged from the loop under common circumstances.

Another technique for retaining the hook involves the incorporation of a resilient spring in a handle to which the hook is connected. The hook is connected to a retainer or stud, which is in turn connected on the edge of the garment bag. It is anticipated that the spring bias in the handle of the hook will create a sufficient force to hold the hook against the retainer and prevent accidental external forces from dislodging the hook from the retainer. While this approach has achieved some success, the almost complete exposure of the hook against the retainer provides the opportunity for the hook to be dislodged when exposed to unanticipated forces during transportation.

Another approach which utilizes spring forces to retain the hook and which attempts to conceal a substantial portion of the hook from unanticipated forces during transportation involves retracting the hook into an interior receptacle extending into the garment bag. A bias spring supplies the retraction force. When the user desires to extend the hook and suspend the garment bag, the hook is withdrawn from the receptacle against the force of the spring. While this approach is generally effective in preventing accidental dislodgement and exposure of the hook, this approach requires the receptacle to extend into the interior of the garment bag and consume space which would otherwise be more effectively used for hanging or packing garments. Since the receptacle generally must be located in the center of an upper edge of the garment bag if the garment bag is to be equally suspended on both sides of the hook, the receptacle interferes with the normal location where a trolley or suspension device is positioned to receive the hooks of the clothes hangers upon which the clothes are suspended.

It is with respect to these and other considerations applicable to prior art garment bags that the present invention has evolved.

SUMMARY OF THE INVENTION

One of the principal aspects of the present invention relates to locating a garment hook in a recess at an exterior surface of a garment bag in such a manner that external unanticipated random forces are generally ineffective in dislodging the hook from the recess. Another important aspect of the present invention relates to locating the hook in a recess so it can be easily dislodged and extended by the user to lift the garment bag and suspend it from a closet rod or door edge. A further aspect of the present invention relates to orienting the hook at the exterior of the garment bag to obtain an additional function, such as creating a carrying handle for the closed garment bag. Another important aspect of the invention relates to a method of carrying or maneuvering a closed garment bag during use by orienting and retaining a garment bag hook and flexible connector to form a carrying, maneuvering or lifting handle for the bag.

In accordance with these and other aspects, a recessed hook assembly of the present invention comprises a housing defining a recess, a hook member adapted for suspending the garment bag during use, the hook member having a curved portion for fitting within the recess, an elongated flexible member connected at one end thereof to the hook member, and a retraction mechanism connected to the other end of the flexible elongated member. The retraction mechanism applies a retraction force to bias the flexible member toward the retraction mechanism and the hook member into the recess.

Preferably, the hook member has a concave shaped curved surface, the housing has a convex shaped curved surface, and the convex curved surface of the recess fits within the concave curved surface of the hook member upon positioning the hook member in the recess. The curved portion of the hook member terminates in an end, and the recess forms an indention into which the end of the hook member fits. An over-center condition results which helps prevent the hook member from being dislodged from the recess. The end of the hook member and the indention in the recess each include engaging contact surfaces which contact one another to further resist dislodgement of the hook member from the recess. Further still, the dimensions of aspects of the end of the hook member and the indention create a slight restraining force to further restrain the hook member in the recess.

In accordance with these and other aspects, the present invention also involves a method of using a garment bag suspension hook member and a flexible elongated member connected to the garment bag hook member as a handle for carrying or maneuvering a folded closed garment bag. The method comprises steps of connecting a housing defining a recess to a wall of the garment bag, fitting a hook member adapted for suspending the garment bag during use into the recess, connecting one end of an elongated flexible member to the hook member and the other end of the flexible member to the garment bag, applying a retracting force to the elongated flexible member to maintain the hook member in the recess, extending the flexible member away from a surface of the garment bag while the retraction force is applied, and gripping the flexible member at the location where it is extended away from the garment bag to carry or maneuver the garment bag. The method further preferably comprises the steps of forcing the hook member away from the housing in a direction longitudinal to the length of the elongated member to remove the hook member from the recess, gripping the hook member to lift the garment bag after removing the hook member from the recess, and placing the hook member over a closet rod or upper door edge to suspend the garment bag.

A more complete appreciation of the present invention and its scope can be obtained from understanding the accompanying drawings, which are briefly summarized below, and the following detailed description of a presently preferred embodiment of the invention, and the appended claims.

BRIEF DESCRIPTION OF THE DRAWINGS

FIG. 10 is an enlarged sectional view of the hook, a housing and a corner member of the recessed hook assembly, taken substantially in the plane of line 10—10 of FIG. 3.

FIG. 11 is an enlarged sectional view of a retract mechanism of the recessed hook assembly, taken in the plane of line 11—11 of FIG. 2.

FIG. 12 is a section view of FIG. 11 taken substantially in the plane of line 12—12.

DETAILED DESCRIPTION

Figure 1:
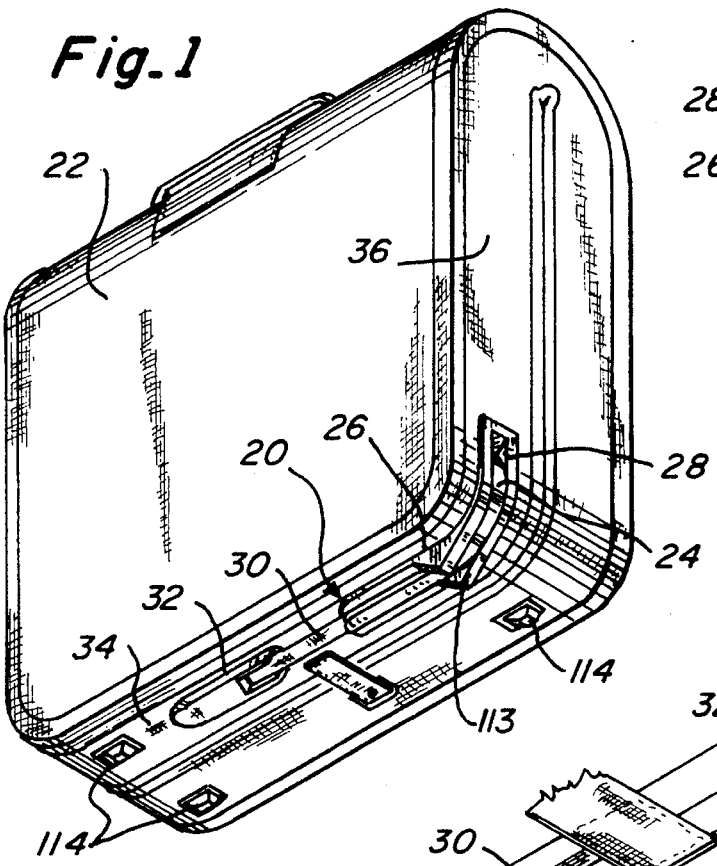
FIG. 1 is a lower perspective view of a garment bag in a closed position for transportation, incorporating a recessed hook assembly embodying the present invention.

A recessed hook assembly 20 which embodies the present invention is shown in FIG. 1 attached to a garment bag 22. The recessed hook assembly 20 generally includes a hook member 24, a housing 26 defining a recess 28 for receiving the hook 24, and an elongated flexible member such as a belt 30 connected to the hook and extending to a retraction mechanism 32. The hook 24 is held in the recess by retraction force applied on the belt 30 by the retraction mechanism 32. The retraction mechanism also allows the hook 24 to be withdrawn from the recess 28.

Figure 2:
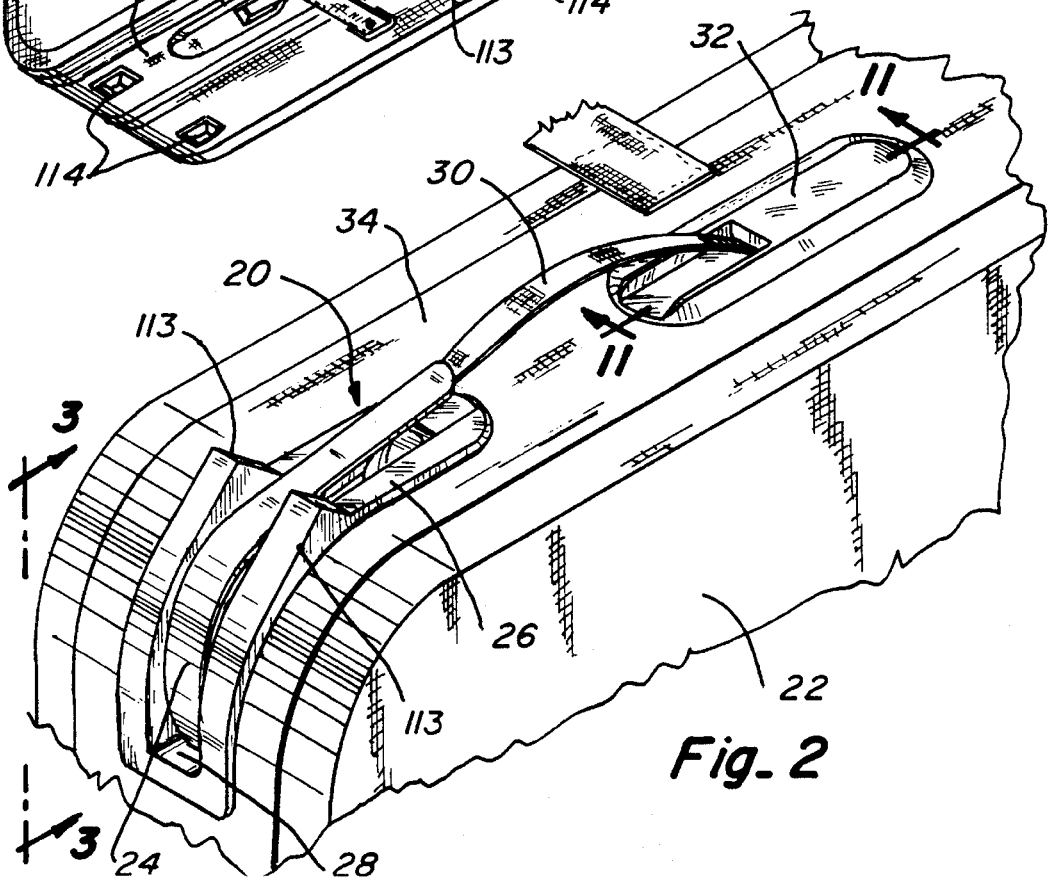
FIG. 2 is an enlarged perspective view of the closed garment bag of FIG. 1 shown in an inverted position to illustrate use of the recessed hook assembly as a carrying, maneuvering or lifting handle.

The hook 24 is retained in the recess 28 when the garment bag is carried in the closed position as shown in FIG. 1. If the garment bag 22 is inverted in the closed position, as shown in FIG. 2, the belt 30 can be gripped as a carrying handle to carry the garment bag in the inverted position. The recessed hook assembly 20 prevents the hook 24 from coming out of the recess 28 when the belt 30 is used as a carrying, lifting or maneuvering handle. Even if the garment bag 22 is not carried in the inverted position as shown in FIG. 2, the belt 30 can still be gripped as a handle to assist in lifting or maneuvering the garment bag.

Figure 3:
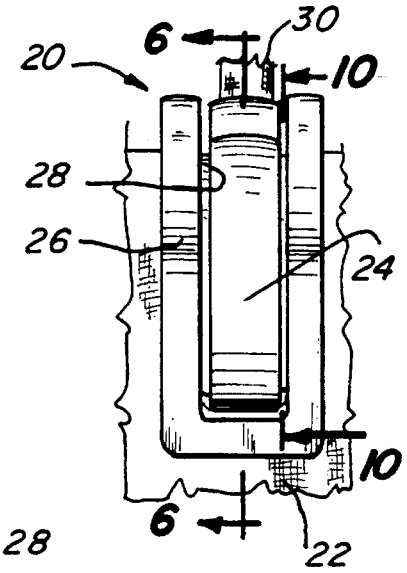
FIG. 3 is a partial side elevational view of FIG. 2 taken substantially in the plane of line 3—3.

To gain access to the belt 30, the retraction mechanism 32 allows the belt 30 to extend. The hook 24 is pivoted slightly within the recess 28 as is shown in FIGS. 2, 3 and 10, and the belt 30 extends above an upper end wall 34 of the garment bag 22 as shown in FIG. 2. However, even in the slightly pivoted position, the hook is maintained in the recess, and the tension applied to the belt 30 when used as a handle assists in maintaining the hook 24 in the recess 28.

Figure 4:
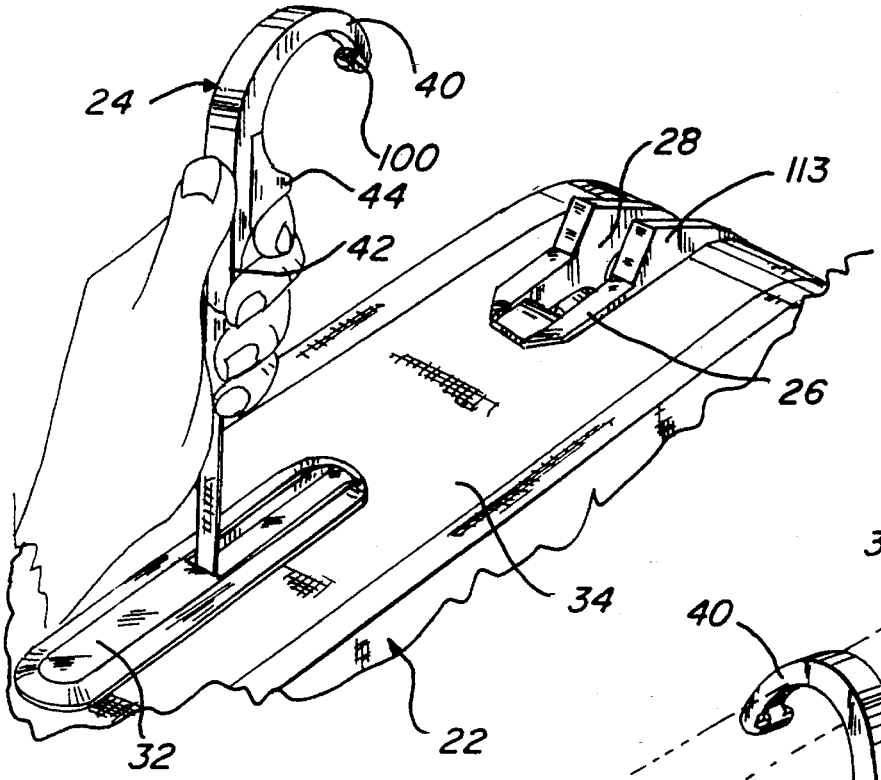
FIG. 4 is a partial perspective view of the garment bag shown in FIG. 1 in an open position, with a hook of the recessed hook assembly extended for lifting the garment bag.
Figure 5:
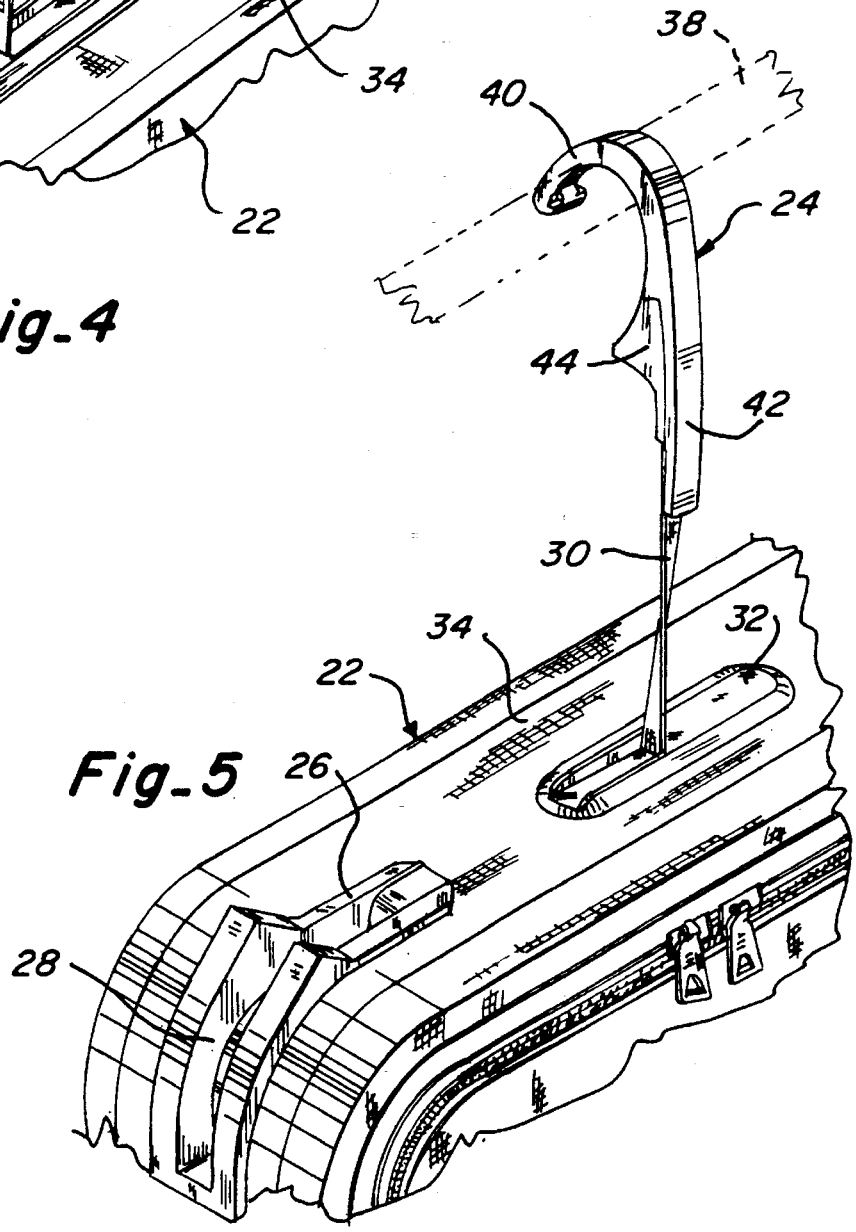
FIG. 5 is a partial perspective view of the garment bag shown in FIG. 4 in a vertically suspended position with the hook connected to a closet rod or an upper door edge.

To suspend a garment bag by the hook 24, the hook is removed from the recess 28 by pushing the hook away from the retraction mechanism 28 in a direction parallel to the upper end wall 34, while the hook is in the slightly pivoted position. The hook 24 readily comes out of the recess 28, because the retraction mechanism 32 allows the belt 30 to sufficiently extend. The user then grips the hook, as shown in FIG. 4, and lifts the garment bag 22 and places the hook 24 over a closet rod or upper door edge, both of which are represented at 38. The retraction mechanism 32 transfers the weight of the bag to the belt 30. The retraction mechanism 32 is of a size sufficient to distribute that weight or force over a significant area of the upper end wall 34, thereby preventing significant distortion or damage to the garment bag 22.

To place the garment bag in a closed position as shown in FIG. 1, the user grips the hook 22, lifts the hook and garment bag off of the closet rod or upper door edge 38 and places the bag 22 on a horizontal surface. The hook 24 is then placed into the recess 28 and the retraction force applied by the retraction mechanism 32 holds the hook 24 in the recess 28. Thereafter, the bag can be folded in half to the closed position as shown in FIG. 1 and transported, using the belt 30 as a handle if desired.

More details concerning the recessed hook assembly 20 are shown in FIGS. 6 to 12.

Figures 6, 7, 8, 9:
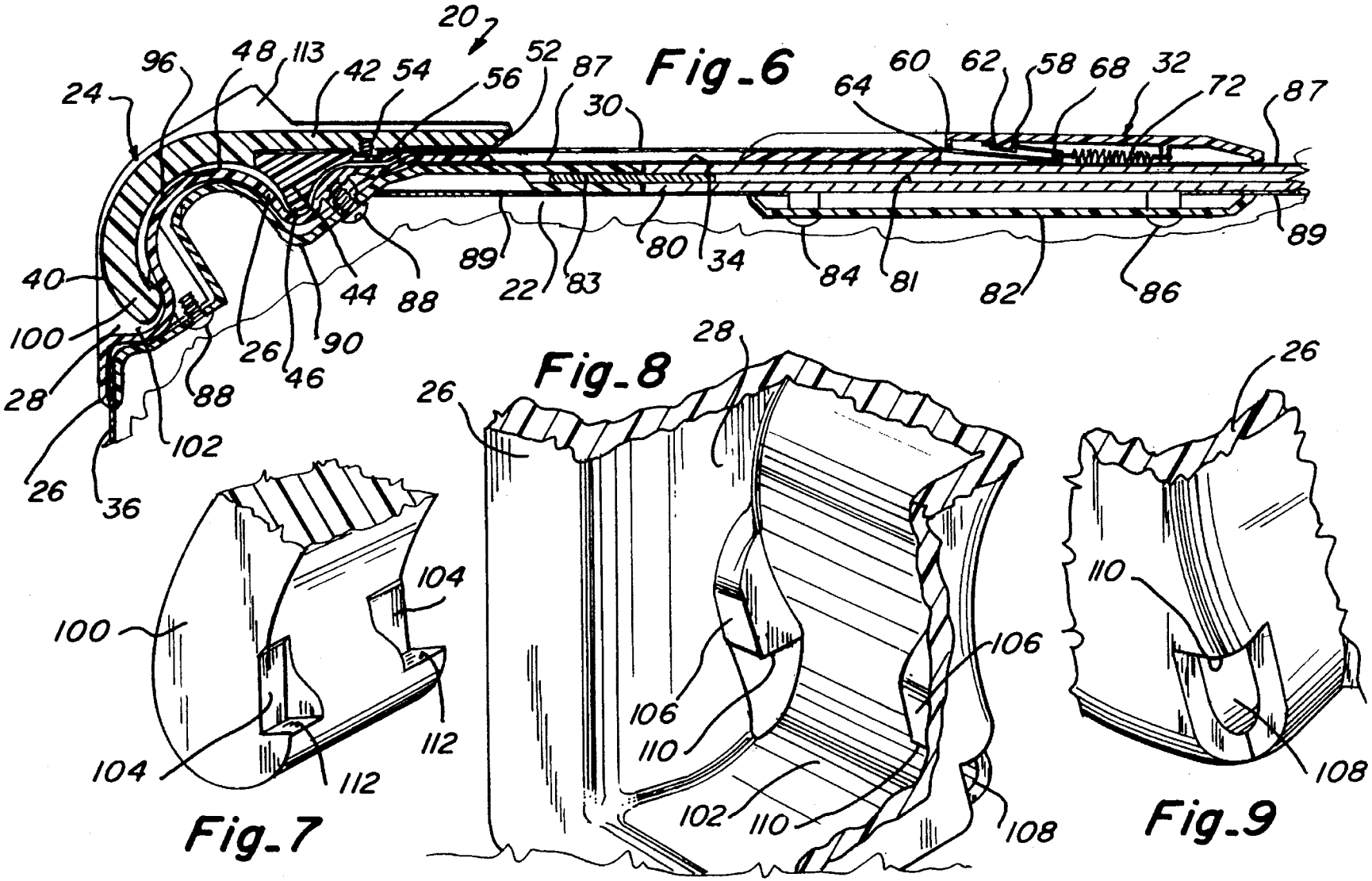
FIG. 6 is a vertical section view of the recessed hook assembly attached to the garment bag, taken substantially in the plane of line 6—6 of FIG. 3.
FIG. 7 is an enlarged partial perspective view of an end of the hook shown in FIGS. 1 to 6.
FIG. 8 is an enlarged partial perspective view of an indention portion of a recess adapted to interact with the end of the hook shown in FIG. 7 when the hook is positioned in the recess as shown in FIGS. 1, 2, 3 and 6.
FIG. 9 is a partial perspective view of FIG. 8 taken from the opposite perspective.

The hook 24, as shown in FIGS. 6 and 10, includes a curved portion 40 and a mostly straight handle portion 42. An extension 44 of the hook 24 is connected to the handle portion 42 at the location where the curved portion 40 extends into the handle portion 42. A protruding portion 46 extends from the extension 44. The protruding portion and the curvature of the curved portion 40 generally create a semicircular curved surface 48. The protruding portion 46 also includes a curved surface 50 which generally faces toward a rear end 52 of the handle portion 42.

The extension 44 is connected to the handle portion 42 by a fastener such as a screw 54. The screw 54 passes through an end 56 of the belt 30. The force applied from the screw 54 through the extension 44 against the end 56 of the belt, coupled with the passage of the screw 54 through the end 56 of the belt 30, hold the belt securely to the hook 24.

The retraction mechanism 32, as shown in FIGS. 6, 11 and 12, applies a retraction bias force to the belt 30. The opposite end 58 of the belt 30 is attached securely by a fastener 62 to a housing 60 of the retraction mechanism 32. The belt 30 enters the housing 60 through a slot 64 in the housing. Thereafter, the belt is looped around a straight link 66 of a closed ring member 68, forming a reverse overlap, and the end 58 of the belt 30 is secured at the fastener 62. The ring member 68 includes a V-shaped edge 70 which is generally opposite of the link 66. One end of a spring 72 is connected at the center of the V-shaped edge 70. The other end of the spring 72 is connected to a post 74 extending from the housing 60 of the retraction mechanism 32.

Bias force supplied by the spring 72 pulls the ring member 68 in a direction to the right as shown in FIGS. 11 and 12, and thereby pulls the belt 30 through the slot 64 and into the retraction mechanism. The exterior surface of the belt 30 is preferably smooth so that it will bend and slide without significant restraint around the straight link 66 of the ring member 68. Protrusions 76 extend from the housing 60 to contact the V-shaped edge 70 of the ring member 68 and limit the maximum amount of retraction of the belt. Similarly, protrusions 78 limit the maximum extension of the belt when the link 66 contacts those protrusions 78. By doubling the belt 30 around the link 66, the belt 30 may be extended and retracted an amount equal to twice the length which the ring member 68 travels between the protrusions 76 and 78. Consequently, a relatively small sized retraction mechanism will accommodate a considerably greater linear amount of extension and retraction of the belt 30.

The housing 60 for the retraction mechanism 32 is attached to a support member 80 located at or within the upper end wall 34 of the garment bag 22 as shown in FIG. 12. A cap 82 is located in the interior of the garment bag opposite the housing 60. Fasteners 84 and 86 extend between the cap 82 and the housing 60 to hold the cap and housing in place on the support member 80. The fasteners 86 extend into the protrusion 76. When the fasteners are drawn tight, the housing 60 is held against an outer fabric 87 from which the garment bag 22 is constructed, and the cap 82 is held against an inner liner 89 within the garment bag.

The housing 26 which provides the recess 28 is connected on the exterior of the garment bag at the intersection of the upper end wall 34 and the side wall 36, as shown in FIGS. 6 and 10. The recess housing 26 is connected by fasteners 88 to an interior corner member 90. The corner member 90 is attached to the upper end wall support member 80 and is generally located within the interior of the garment bag. Extruded thermoplastic strip is the preferred material for support member 80. One well known type has a series of longitudinally extending cavities 81 between its upper and lower surfaces to decrease weight and material usage while retaining beam stiffness. The corner member 90 and support member 80 are connected by a series of metal pins 83 which protrude from the adjacent end of the corner member 90 and insert into the open ends of several of the cavities 81. The fabric material 87 extends on the exterior of the corner member 90, and the liner 89 may cover the corner member 90 within the interior of the garment bag 22. The fabric 87 is trapped between the exterior recess housing 26 and the interior corner member 90 when the fasteners 88 draw the corner member 90 and the recess housing 26 together.

Both the corner member 90 and the recess housing 26 include complimentary shaped semicircular center portions 92 and 94, respectively. The semicircular shaped center portion 92 of the corner member 90 fits within the semicircular shaped center portion 94 of the housing recess 26. An exterior convex shaped curved surface 96 of the center portion 94 generally conforms with the concave shaped curved surface 48 of the hook 24. When the hook 24 is placed in the recess 28, the curved surface 48 generally contacts the exterior curved surface 96 of the recess 28. Another curved portion 98 of the housing recess 26 generally lies in close conformance or contact with the curved surface 50 of the hook 24.

The position of the corner member 90 and the recess housing 26, and the orientation of the curved surface 96 in cooperation with the curved surface 48 of the hook 24 create a concentric condition to assist in retaining the hook 24 in the recess 28. That is, a condition where displacement of the hook 24 from or into its concentric position around the surface 96 (FIGS. 6 and 10) requires moving the hook against a spring bias, specifically against the biasing force provided by spring 72 via the belt 30. The over-center condition results because an end 100 of the curved portion 40 of the hook 24 fits in concentric relationship with the curved surface 96 within an indention 102 of the recess 28 where the curved surface 96 of the housing 26 transitions back outward to the side wall 36. In order to remove the end 100 of the hook 24 from the indention 102, it is necessary to move the hook 24 to the left as shown in FIGS. 6 and 10 to allow the end 100 of the hook to clear the left-most curvature of the curved surface 96 to the left (as shown) of the indention 102. To move the hook 24 to the left (as shown), it is necessary to overcome the retraction bias applied by the retraction mechanism 32 on the belt 30. However, it is relatively easy to move the hook in this manner by contacting the rear end 52 of the handle portion 42 with a finger to lift it slightly to the pivoted position shown in FIG. 10 and then grip the hook and pull it outward away from the retraction mechanism 32.

In addition to the over-center condition created by the orientation of the indention 102 relative to curved surface 96, the end 100 of the hook has formed therein a pair of contact receptacles 104 as shown in FIG. 7. The contact receptacles 104 are intended to fit within contact shoulders 106 formed in the indention 102 of the recess 28, as shown in FIGS. 8 and 9. The contact shoulders 106 protrude out of the indention 102 at its corners, as shown in FIG. 9. An open cutaway space 108 below the shoulders 106 forms a contact surface 110 which rests against another contact surface 112 formed in the contact receptacles 104, as is shown in FIG. 10.

The distance between the contact receptacles 104 at the end 100 of the hook is slightly greater than the distance between the contact shoulders 106 formed in the indention 102. This difference in distance forces the contact shoulders 106 slightly outward to apply a slight restraining force on the end 100 of the hook, thereby further assisting in preventing the hook 24 from dislodging from the recess 28. This retention force also causes the hook to snap into place when it is properly placed into the recess, thereby signaling the user of the proper orientation of the hook.

The housing 26 also includes a pair of projections 113 extending from the housing 26 on each side of the recess 28, as is shown in FIGS. 3, 6 and 10. The projections 113 serve a number of useful purposes. Since the projections 113 are located on the opposite sides of the recess 28, force on the belt 30 applied in a direction transverse to its extension and parallel to the upper end wall 34 does not readily twist the hook from the recess. The projections 113 guard the hook against laterally applied forces. As a result, the hook 24 cannot be twisted out of the recess 28. The projections 113 thus allow the belt to be gripped and lifting forces applied in a direction transverse to the belt in two directions, one parallel to the upper end wall 34 and another orthogonal to the upper end wall 34.

The projections 113 also serve as glides to support the bottom or downward facing end walls of the folded or closed garment bag as shown in FIG. 1. Other glides 114 are located at the other corners of the downward facing end walls of the closed bag to compliment the projections 113. The glides 114 and the projections 113 cause the belt 30 and handle portion 42 of the hook 24 never to contact a smooth flat support surface such as a floor, thereby further inhibiting the possibility that an unintentionally applied force will dislodge the hook 24 from the recess 28.

Because of the effective manner in which the hook 24 is retained in the recess 28, it is extremely difficult or impossible to dislodge the hook 24 from the recess 28 except upon the application of a force on the rear end 52 of the handle portion 42 of the hook parallel to the belt and away from the retraction mechanism. While such an unintended force is theoretically possible, most unintentionally applied forces will be applied generally transverse to the hook. However, the projections 113 guard the hook from such forces and inhibit the hook from twisting out of the recess. On the other hand, the relative ease in which the end 52 of the hook can be lifted allows the hook to be easily removed from the recess by intentional force. The curved surface 50 of the extension 44 of the hook 24 allows the weight of the suspended garment bag to be easily restrained by hand, as shown in FIG. 4, without interfering with the placement of the curved portion 40 of the hook 24 over a closet rod or upper edge of an open door 38. Thus, the extension 44 allows the garment bag to be more easily lifted by the hook 24.

Preferably the hook 24, the recess housing 26, the corner member 90, the retraction mechanism housing 60 and the cap 82 are formed of injection molded plastic, thereby substantially reducing their cost. The belt 30 may be formed of conventional flexible material, and preferably is resistant to stretching. The cost of the recessed hook assembly 20 constructed in this manner is considerably less than other types of hook assemblies which use metal materials and labor-intensive construction and assembly techniques. Many other advantages and improvements will be apparent upon full comprehension of all aspects of the present invention.

A presently preferred embodiment of the invention and many of its improvements have been described with a degree of particularity. This description has been made by way of preferred example for implementing the invention. However, the scope of the invention should not necessarily be limited by this description, but instead is defined by the following claims.

The invention claimed is:

1. In a garment bag having an upper end wall from which the garment bag may be suspended when used, a recessed hook assembly comprising:

a housing connected to the upper end wall, the housing defining a recess, and the housing comprising a convex curved surface facing out of the recess;

a hook, dimensionally corresponding to and positionable substantially entirely within the recess, adapted for suspending the garment bag during use and having a curved portion comprising a concave curved surface corresponding generally to the convex curved surface of the housing;

an elongated flexible member connected at one end thereof to the hook;

a retraction mechanism connected to the upper end wall and to which another end of the elongated flexible member is connected, the retraction mechanism applying a retraction force biasing the elongated flexible member toward the retraction mechanism;

projections extending outwardly from the housing and substantially perpendicularly from the upper end wall on opposite sides of the recess; and wherein the convex curved surface of the housing fits concentrically within the concave curved surface of the hook when the hook is positioned in the recess.

2. A recessed hook assembly as defined in claim 1 wherein the garment bag further includes a side wall joining the upper end wall at a corner, and wherein:

the housing is attached at the corner of the garment bag; and the retraction mechanism is attached at a center location of the upper end wall.

3. A recessed hook assembly as defined in claim 1 wherein:

when the hook is substantially entirely within the recess, the elongated flexible member is substantially parallel to the recess and the retraction force applied through the elongated flexible member to the hook biases the concave curved surface of the hook against the convex curved surface of the housing.

4. A recessed hook assembly as defined in claim 3 further comprising:

an end on the curved portion of the hook, the end having at least two opposing sides; and an indentation in an end of the recess, the indentation having at least two opposing sides substantially parallel to the opposing sides of the end of the hook when the hook is positioned in the recess; wherein the convex curved surface of the housing is generally between the indentation and the retraction mechanism, and the end of the curved portion of the hook is engageable into the indentation.

5. A recessed hook assembly as defined in claim 4 wherein:

the curvature of the convex curved surface of the housing extends outwardly from the indentation to guide the concave curved surface of the hook into a concentric position relative to the convex curved surface of the housing when the hook is positioned in the recess.

6. A recessed hook assembly as defined in claim 5 further comprising:

contact receptacles on the opposing sides of the end of the hook and separated by a first dimension, each receptacle defining a separate contact surface; and contact shoulders on the opposing sides of the indentation of the recess and separated by a second dimension, each contact shoulder defining a separate contact surface engageable with a receptacle contact surface when the hook is positioned in the recess.

7. A recessed hook assembly as defined in claim 6 wherein:

the first dimension is greater than the second dimension, causing a snap-fit restraining force on the hook when the hook is positioned in the recess.

8. A recessed hook assembly as defined in claim 1 wherein:

the elongated flexible member comprises a belt, the belt comprising a material resistant to stretching.

9. A recessed hook assembly as defined in claim 1 wherein:

the projections inhibit the hook from dislodging from the recess and toward either of the opposite sides of the recess.

10. A recessed hook assembly as defined in claim 9 wherein the garment bag further comprises a bottom end wall, and wherein the garment bag is foldable into a closed position with the upper end wall and the bottom end wall substantially adjacent to one another, and wherein further the garment bag is positionable upon a support surface in the closed position with the end walls proximate to and substantially parallel to the support surface, and wherein:

the projections act as support glides, when the garment bag is positioned upon the support surface in the closed position, substantially to prevent the housing and hook from contacting the support surface.

11. A recessed hook assembly as defined in claim 1 wherein the retraction mechanism comprises a resilient member operatively connected to the elongated flexible member to apply the retraction force to the elongated flexible member while simultaneously allowing extension and retraction of the elongated flexible member.

12. A recessed hook assembly as defined in claim 11 wherein the resilient member comprises a spring having two ends, and the retraction mechanism further comprises:

a housing; and a ring defining a straight link at one end and a V-shaped edge at its other end;

and wherein the spring is attached at one end to the housing and is attached at its other end to the V-shaped edge of the ring;

and wherein further an end of the elongated flexible member is looped through the ring and reverse overlapped onto itself over the straight link end of the ring and is attached to the housing of the retraction mechanism;

and wherein further the spring is extendable to allow the elongated flexible member to be extracted from the retraction mechanism, and wherein the spring applies a retraction force to retract the elongated flexible member; and wherein further the elongated flexible member may obtain a retraction and extension distance from the retraction mechanism which is greater than the movement of the spring and the ring.

13. A recessed hook assembly as defined in claim 1 wherein the garment bag includes a support structure adjoining the upper end wall, and wherein:

the retraction mechanism is attached to the support structure approximately at a center location of the upper end wall;

the hook supports the garment bag in vertical position; and the retraction mechanism transfers the weight of the garment bag to the support structure.

14. In a garment bag having an upper end wall from which the garment bag may be suspended when used, a recessed hook assembly comprising:

a housing connected to the upper end wall, the housing defining a recess, and the housing comprising a convex curved surface facing out of the recess;

a hook, dimensionally corresponding to and positionable substantially entirely within the recess, adapted for suspending the garment bag during use and having a curved portion comprising a concave curved surface corresponding generally to the convex curved surface of the housing;

an elongated flexible member connected at one end thereof to the hook;

a retraction mechanism connected to the upper end wall and to which another end of the elongated flexible member is connected, the retraction mechanism applying a retraction force biasing the elongated flexible member toward the retraction mechanism;

an end, having at least two opposing sides, on the curved portion of the hook;

an indentation in the recess, the indentation having two opposing sides substantially parallel to the sides of the end when the hook is positioned in the recess;

contact receptacles on the opposing sides of the end of the hook and separated by a first dimension, each receptacle defining a separate contact surface;

contact shoulders on the opposing sides of the indentation of the housing and separated by a second dimension, each contact shoulder defining a separate contact surface engageable with a receptacle contact surface; and wherein the end of the curved portion of the hook is engageable into the indentation, and the convex curved surface of the housing fits concentrically within the concave curved surface of the hook, when the hook is positioned in the recess.

15. A recessed hook assembly as defined in claim 14 wherein:

the first dimension is greater than the second dimension, causing a snap-fit restraining force on the hook when the hook is positioned in the recess.

* * * * *